United States Patent [19]

Levänen

[11] 4,220,502

[45] Sep. 2, 1980

[54] TWIN-WIRE WEB FORMING SECTION IN A PAPER MACHINE

[75] Inventor: Kyösti Levänen, Jyväskylä, Finland

[73] Assignee: Valmeta Oy, Finland

[21] Appl. No.: 8,381

[22] Filed: Feb. 1, 1979

[30] Foreign Application Priority Data

Feb. 7, 1978 [FI] Finland ..... 780380

[51] Int. Cl.[2] ..... D21F 1/24; D21F 1/40

[52] U.S. Cl. ..... 162/273; 162/300; 162/301; 162/DIG. 7

[58] Field of Search ..... 162/300, 301, 203, 264, 162/DIG. 7, 273

[56] References Cited

U.S. PATENT DOCUMENTS

| | | | |
|---|---|---|---|
| 3,746,613 | 7/1973 | Vauhkonen | 162/301 |
| 3,997,390 | 12/1976 | Kankaanpaa | 162/203 X |
| 4,033,812 | 7/1977 | Riihinen | 162/301 X |
| 4,055,461 | 10/1977 | Turunen | 162/301 X |

*Primary Examiner*—Richard V. Fisher

*Attorney, Agent, or Firm*—Steinberg and Blake

[57] ABSTRACT

A twin-wire web forming section in a paper machine includes a lower endless carrying wire which laps a forming roll and an upper endless covering wire which laps at least a part of the portion of the lower carrying wire which laps the forming roll. First and second substantially straight runs of the carrying wire are defined prior and subsequent to the forming roll, respectively, in the direction of travel of the lower endless carrying wire, the first straight run comprising the initial single-wire portion of a web-forming zone. An open-surfaced forming board is operatively associated with the initial single-wire portion. A headbox is disposed at the forward end of the initial single-wire portion, the longitudinal axis of which is substantially aligned with the direction of movement of the initial single-wire portion. The direction of movement of the initial single-wire portion is directed upwardly at an acute angle with the horizontal while the second substantially straight run subsequent to the forming roll is directed downwardly forming a second acute angle with the horizontal. The length and position of the twin-wire portion defined by the lapping carrying and covering wires is selectively adjustable by suitable adjustment of breast and traction rolls around which the endless covering wire is trained.

8 Claims, 1 Drawing Figure

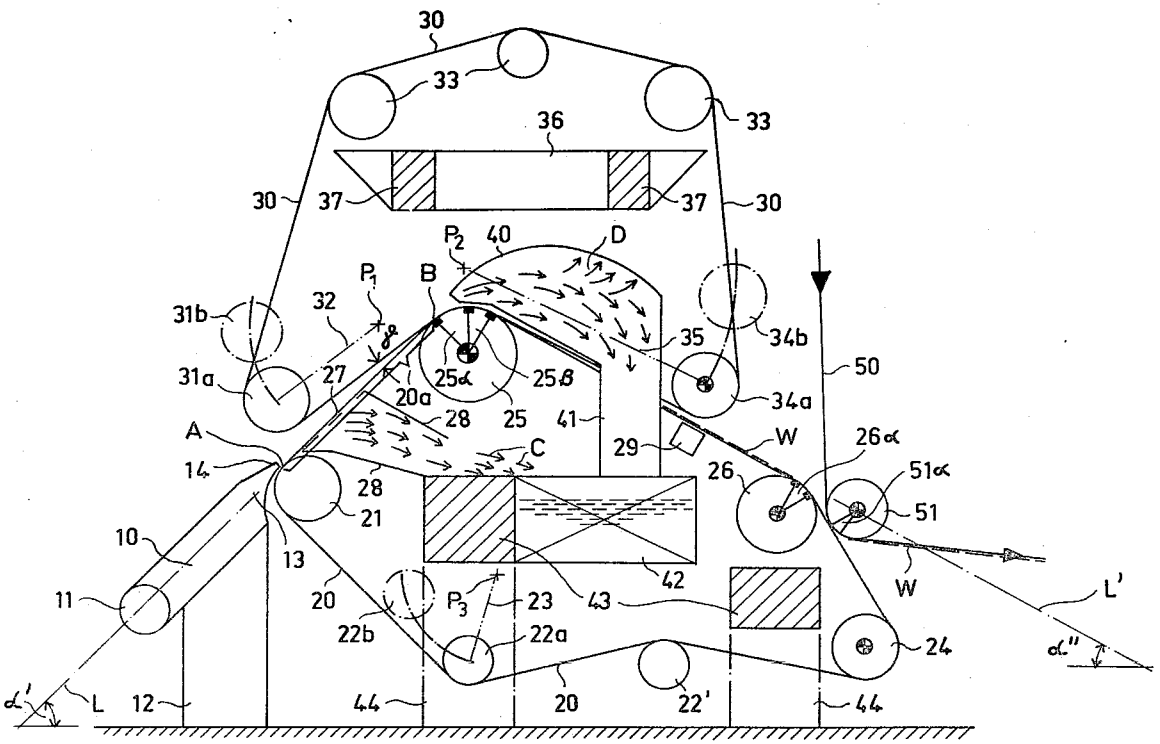
10
11
12
13
14
20
20a
20b
21
22
22a
22b
23
24
25
25a
25b
26
26a
27
28
29
30
31a
31b
32
33
34a
34b
35
36
37
40
41
42
43
44
50
51
51a
A
B
C
D
L
L'
W
P1
P2
P3

TWIN-WIRE WEB FORMING SECTION IN A PAPER MACHINE

BACKGROUND OF THE INVENTION

This invention relates generally to paper making machines and, more particularly, to a twin-wire web forming section of a paper machine.

Twin-wire web forming sections of paper making machines are known. Such conventional twin-wire web forming sections generally extend in a horizontal direction and are relatively long due to the fact that the initial single-wire portions comprising the web-forming zone of the section necessarily is of a great length. Thus, such conventional twin-wire web forming sections are disadvantageous in that they require a great deal of space for their construction.

Due to the relatively great length of conventional twin-wire web forming sections, the location of the associated headboxes is restricted so that it is not always feasible to accommodate damping tanks, when such are desired, as close to the lip aperture of the headbox as would ordinarily be desired. For the same reason, it is not always possible to utilize a straight lip portion in the headbox which is desirable in order that the stock can flow onto the carrying wire in a uniform manner.

Further, such conventional twin-wire web forming sections generally require relatively complex water conveying apparatus due to their relatively large lengths. Such water conveying apparatus are costly both in their manufacture and operation.

Finally, again as a consequence of the relatively great lengths of conventional twin-wire web forming sections, it is difficult to change the carrying wire when such becomes necessary.

SUMMARY OF THE INVENTION

Accordingly, one object of the present invention is to provide a new and improved twin-wire web forming section for a paper machine.

Another object of the present invention is to provide a new and improved twin-wire web forming section which requires a space for its construction which is considerably reduced in longitudinal extent relative to conventional twin-wire forming sections.

Still another object of the present invention is to provide a new and improved twin-wire web forming section wherein the associated headbox can be more advantageously positioned and, in particular, wherein the headbox can be located in a manner whereby a damping tank can be located as close to the headbox lip aperture as possible.

Yet another object of the present invention is to provide a new and improved twin-wire web forming section wherein the stock flow will discharge from a straight lip portion to provide a uniform discharge of the stock onto the wire.

Yet still another object of the present invention is to provide a new and improved twin-wire web forming section wherein a more advantageous apparatus for conveying water from the web-forming stock is provided.

Still yet another object of the present invention is to provide a new and improved twin-wire web forming section wherein a wire change may be expeditiously accomplished by the so-called cantilever system.

In accordance with the present invention, these and other objects are attained by providing a twin-wire web forming section for a paper machine including a lower endless carrier wire which laps a former roll located within its loop to define in the direction of travel of the wire a substantially straight initial single-wire portion prior to the former roll and a second substantially straight carrier wire run subsequent to the former roll. An upper endless covering wire is directed by adjustably mounted breast and traction rolls so that the covering wire overlies at least a portion of the carrier wire which laps the former roll to define a twin-wire run at the former roll. According to the invention, the longitudinal direction of the headbox and the initial single-wire portion of the carrier wire are substantially aligned and directed upwardly, this direction forming a substantial acute angle with the horizontal. The second substantially straight run of the carrier wire following the former roll is directed downwardly so as to also define a substantial acute angle with the horizontal. The length and/or position of the twin-wire run may be selectively adjusted by adjusting in a substantially vertical plane the position of the breast and traction rolls which guide the upper endless covering wire. In this manner, the horizontal extent of the twin-wire web forming section is considerably reduced and the headbox can be located with respect to the initial single-wire portion of the carrier wire in a manner whereby a damping tank can be located, if desired, as close to the headbox lip aperture as possible with the headbox having a straight lip portion for providing a uniform discharge of the stock onto the wire.

Further, the particular configuration of the forming section as described above permits the provision of a single save-all located within the loop of the lower carrier wire. Water escaping in the region of a forming board provided along the initial single-wire run as well as in the region of the former roll may be directly conveyed into this single save-all.

DESCRIPTION OF THE DRAWING

The FIGURE illustrates a schematic elevational view of the twin-wire forming section of the present invention.

DESCRIPTION OF THE PREFERRED EMBODIMENT

Referring now to the drawing, the twin-wire web forming section includes generally a lower endless carrying wire 20 in the loop of which a former roll 25 is disposed, the carrying wire lapping the former roll. An upper endless covering wire 30 is provided which is directed by breast and traction rolls 31, 34 so as to overlie at least a part of the carrying wire 20 which laps the former roll 25 defining a twin-wire run. The web forming stock is discharged from a headbox 10 onto the upstream end of the carrying wire (at the left as seen in the FIGURE) with the web being impacted or sandwiched between the carrying and covering wires at the region of the former roll 25. The headbox 10 is mounted on a pedestal 12 and includes a conventional distribution header 11 and a tapering straight lip portion 13 defining a lip slice 14 which opens onto the upstream end of the carrying wire 20.

Throughout the description of the illustrated embodiment, reference is made to the wires 20, 30. However, it should be understood that the present invention is not limited to wires per se but, rather, the term is used generically to include any other equivalent fabrics.

As is clearly shown in the drawing, the carrying wire 20 is directed so as to define in the direction of travel of the carrying wire 20 a first substantially straight run 20*a* immediately prior to former roll 25 and a second substantially straight run immediately subsequent to the former roll. The first substantially straight run 20*a* of carrying wire 20 comprises the initial single-wire portion of a web-forming zone.

In addition to former roll 25, within the loop of the carrying wire 20 is a breast roll 21 adjacent to headbox 10, and thereafter in the direction of travel of the carrying wire 20, an open-surfaced forming board 27 in opposed operative relationship with the initial single wire portion 20*a* of the carrying wire 20. Of course, other equivalent foil equipment may be advantageously employed in lieu of the forming board 27 and it is understood that the term forming board includes such equivalent equipment. Subsequent to forming board 27 in the direction of travel of carrying wire 20 is the former roll 25 which, in the illustrated preferred embodiment, is provided with two suction zones 25 $\alpha$ and 25 $\beta$. A suction device illustrated as a planar suction box 29, follows former roll 25 and is operatively associated with the carrying wire 20 along the second substantially straight run thereof. Of course, any conventional suction device may be utilized in this regard, such for example as a suction roll. A suction roll 26 having a suction zone 26 $\alpha$ follows the suction box 29 and defines the downstream end of the second substantially straight run of the carrying wire 20. A traction roll 24 is provided and the carrying wire is further guided by the automatic guide roll 22' and the automatic tension roll 22, the latter being adjustable between the extreme positions designated 22*a*, 22*b* by means of the schematically illustrated arms 23 pivoted about the center of rotation $P_3$.

The loop of the upper covering wire 30 is guided by guide rolls 33 and by breast and traction rolls 31, 34 so that a portion thereof overlies at least a part of but only that portion of the carrying wire 20 which laps the former roll 25, the covering wire 30 thereby being guided in part by the former roll 25. According to the present invention, the breast and traction rolls 31, 34 are adjustably mounted so as to be selectively movable in a substantially vertical direction between the extreme positions 32*a*, 31*b* and 34*a*, 34*b*, respectively. To this end, the breast roll 31 is carried on arms 32 which are pivotally mounted about a center of rotation $P_1$ while the traction roll is carried on arms 35 which are pivotally mounted about a center of rotation $P_2$. The actuating apparatus for movement of the breast and traction rolls are well known and are not shown in the drawing.

The lower endless carrying wire 20 is mounted in a frame including horizontally extending cross beams 43 and upstanding columns 44 while the upper endless covering wire 30 is mounted in a frame including orthogonal beams 36 and 37.

By means of the adjustable mounting of the breast roll 31, as described above, the angle, designated $\gamma$, at which the carrying and covering wires 20, 30 converge and meet in the region of the former roll to define the twin-wire run can be selectively controlled and, in this manner, it is possible to adjust the length of the single-wire portion 20*a* of the web-forming zone, at least within certain limits. This length is seen to extend from point A which is the point at which the carrying wire 20 departs from breast roll 21 and a point designated B. In a similar manner, by suitable adjustment of the position of traction roll 34, the length of the twin-wire run, i.e., the length over which the covering wire 30 overlies carrying wire 20, may be selectively determined. Thus, the covering wire 30 can be deflected away from the carrying wire at any point between one extreme located upstream of the point where the carrying wire departs from former roll 25 and another extreme located downstream of this point. Thus, in this manner, the length of the twin-wire run may be selectively adjusted.

As mentioned above, a planar suction box 29 is operatively engaged with the carrying wire 20 along the second substantially straight run thereof for the purpose of assuring that the web W follows and does not separate from the carrying wire 20. Thus, when the twin-wire run is relatively long, such as when the traction roll 34 is in its lowermost position designated 34*a*, the suction box 29 prevents the web W from departing from the carrying wire 20 and becoming attached to the covering wire 30. When the covering wire is directed to depart from the carrying wire 20 in the region of the former roll, the suction box 29 is not essential to the operation of the apparatus since the second suction zone 25 $\beta$ of the former roll 25 will assure that the web does not separate from the carrying wire 20.

Further, through the suitable adjustment of the positions of the breast and traction rolls 31, 34, the twin-wire run can be adjusted so as to be confined merely to a sector of the forming roll. In other words, the direction of travel of the covering wire 30 may be adjusted so that the covering wire overlies the carrying wire only over a sector of the former roll. By this provision, it is possible to adjust the angular velocities of the wires 20, 30 to be equal to that of the former roll with respect to the center of rotation thereof. This is advantageous in that through such adjustment, the web will not be subjected to deleterious attrition which would otherwise result should a different speed exist between the wires.

By virtue of the above-described construction of the twin-wire run of the present invention, it is possible to accomplish wire changes in the twin-wire section by cantilevering since, for example, there is no necessity for run-out arrangements or the like for the covering wire 30.

According to the present invention, the longitudinal direction of the headbox 10 in the direction of flow of the stock material therein is substantially parallel to and aligned with the initial single-wire portion 20*a* of the web-forming or dewatering zone. This direction is designated by the dot-dash line L in the drawing. As seen in the drawing, the direction of the initial single-wire portion 20*a* and aligned headbox, designated L, extends upwardly in the direction of travel of the carrying wire 20 and forms an acute angle $\alpha'$ which is preferably 45° but which may be any angle within the range of from 30° to 60° with the horizontal. The second substantially straight run of carrying wire 20 following the forming roll is downwardly directed as shown by the dot-dash line L' and defines an acute angle $\alpha''$ with the horizontal of the same order of magnitude as angle $\alpha'$. Preferably, the angle $\alpha''$ is smaller than the angle $\alpha'$. By this particular geometry of the apparatus, several important advantages are achieved. Firstly, the headbox 10 may be advantageously positioned so that a damping tank (not shown) can be located as close to the lip aperture as possible so that the stock flow will discharge from the straight lip portion of the headbox onto the initial single-wire portion of the web forming zone to provide a uniform discharge of the stock onto the wire. Secondly, relatively minimal space requirements are necessary for the former in the machine direction. As will be readily seen, the larger the angles $\alpha'$ and $\alpha''$, the smaller will be the space required in the machine direction and the larger will be the angle subtended by the sector of the former roll lapped by the carrying wire 20.

Another advantage of the configuration of the former section of the present invention resides in the ability to provide an extremely simple yet efficient water conveying system therefor. More particularly, according to the present invention, the water expelled from the stock and formed web over the entire former section can be directed to a single save-all, designated 42. Thus, the water expelled at the region of the forming board 27 is directed by partitions 28 as shown by the arrows C into the save-all 42. A water guide baffle system 40 is mounted over the twin-wire run in the region of the forming roll 25 which directs the water received from the web W due to wire pressure and centrifugal force as shown by arrows D into a substantially vertically disposed chute 41 which is located adjacent to the side of the wires. The water is conducted through the chute into the save-all 42. The water received in the save-all 42 is drained in a conventional manner. Thus, it is seen that by shortening the length of the former section in the machine direction in the manner described in detail above, the apparatus for conducting the water expelled from the web forming stock and formed web is greatly simplified relative to analogous structures and conventional twin-wire web formers.

As described above, the forming roll 25 is provided with a pair of consecutive adjacent suction zones 25 $\alpha$, 25 $\beta$. According to the present invention, the first suction zone 25 $\alpha$ is preferably substantially wider than the second zone 25 $\beta$. The first suction zone may be in the range of between two or three times as wide as the second suction zone. Further, the suction or vacuum acting over the first suction zone 25 $\alpha$ is preferably substantially less than that acting over the second zone 25 $\beta$. By way of illustration, when the width of suction zone 25 $\alpha$ is about 800 mm, it has been found advantageous to have the suction zone 25 $\beta$ extend over a width of about 300 mm. When the vacuum provided in the first suction zone 25 $\alpha$ is about 10 kPa subatmospheric, the vacuum in suction zone 25 $\beta$ can advantageously be about 25 kPa subatmospheric. After passing over the traction roll 26 which is provided with a suction zone 26 $\alpha$, the web is transferred onto a pick-up felt 50 by means of pick-up roll 51, known per se, having a suction zone 51 $\alpha$ as shown in the FIGURE.

One example of possible dimensions for the various rolls employed in connection with a former section according to the present invention having a working width of about 8.5 m includes a forming roll 25 having a diameter of 1600 mm, a suction roll 26 having a diameter of 1200 mm, and guide rolls having a diameter of about 1000 mm where large deflecting angles are employed and of about 850 mm when smaller deflecting angles are used.

Assuming the manufacture of newsprint from newsprint stock, about 10% to 15% of the water contained within the stock discharging from the headbox escapes in the initial single-wire portion 20*a* of the forming zone. About 80% of the water is removed in both directions on the portion of the forming roll 25 on which the twin-wire run is located. This water is expelled mainly through the action of pressure, centrifugal force and vacuum. About 2% of the water is removed at the plane suction box 29 and approximately 5% of the water contained in the stock discharged from the headbox is removed at the suction roll 26.

Obviously, numerous modifications and variations of the present invention are possible in the light of the above teachings. It is therefore to be understood that within the scope of the appended claims the invention may be practiced otherwise than specifically described herein.

What is claimed is:

1. In a paper making machine, a twin wire forming section comprising:

a lower endless carrying wire;

a former roll disposed within the loop defined by said lower endless carrying wire, means defining at least one suction zone on said former roll, the carrying wire having a portion which laps a first sector of the former roll so as to define first and second substantially straight runs of the carrying wire prior and subsequent to said first sector of said former roll, respectively, in the direction of travel of said lower endless carrying wire, said first substantially straight run comprising an initial single-wire portion of a web-forming zone and said second substantially straight run adapted to cooperate with pick-up means at the end thereof;

an upper endless covering wire having a portion directed by breast and traction rolls to lap at least part of that portion of the lower carrying wire which laps said former roll and so that the upper wire is spaced from said first substantially straight run, said lapping upper and lower wire portions defining a twin wire run intermediate of said first and second substantially straight runs, said twin wire run lapping a second sector of said former roll;

means for adjusting the position of said breast and traction rolls in a substantially vertical direction so that the length of said second sector of the former roll lapped by said twin-wire run is adjustable but smaller than said first sector lapped by said carrying wire;

a headbox having a lip slice disposed at the forward end of said initial single-wire portion;

an open-surfaced forming board operatively associated with said initial single wire portion;

and wherein the longitudinal axis of said headbox and the direction of travel of said initial single-wire portion are substantially longitudinally aligned and directed upwardly in the direction of travel of said carrying wire to define a first substantial acute angle with the horizontal and wherein said second substantially straight run is directed downwardly in the direction of travel of said carrying wire to define a second substantial acute angle with the horizontal and wherein the length and position of the twin-wire run is selectively adjustable by suitable adjustment of said breast and traction rolls.

2. Apparatus as recited in claim 1 wherein said first acute angle is in the range of between 30° to 60° and said second acute angle is of the same order of magnitude thereof.

3. Apparatus as recited in claim 2 wherein said first acute angle is about 45°.

4. Apparatus as recited in claim 2 wherein said second acute angle is smaller than said first acute angle.

5. Apparatus as recited in claim 1 wherein said suction zone defining means comprise means for defining two suction zones, the first one of said suction zones in the direction of travel of said carrying wire being substantially wider than the second one of said suction zones.

6. Apparatus as recited in claim 5 wherein said first suction zone defined by said suction zone defining means is in the range of between two and three times wider than the second suction zone defined by said suction zone defining means.

7. Apparatus as recited in claim 5 wherein the suction zone defining means is adapted to apply a vacuum in the first suction zone defined thereby which is substantially less than the vacuum applied by said suction zone defining means in the second zone defined thereby.

8. Apparatus as recited in claim 1 further including water removing means located within the loop defining said second endless covering wire substantially above said twin-wire run in fluid communication with a substantially vertically extending water removal chute means located adjacent the sides of said wires, a save-all located within the loop defining said endless carrying wire and means for conducting water received in the region of the forming board to said save-all.

* * * * *